US011616334B2

(12) United States Patent
Shiratori et al.

(10) Patent No.: US 11,616,334 B2
(45) Date of Patent: Mar. 28, 2023

(54) METHOD OF MANUFACTURING CABLE ASSEMBLY, HORN CHIP USED IN THE METHOD AND CABLE ASSEMBLY MANUFACTURED BY THE METHOD

(71) Applicant: JAPAN AVIATION ELECTRONICS INDUSTRY, LIMITED, Tokyo (JP)

(72) Inventors: Masayuki Shiratori, Tokyo (JP); Kenji Kameda, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/522,868

(22) Filed: Nov. 9, 2021

(65) Prior Publication Data

US 2022/0216661 A1 Jul. 7, 2022

(30) Foreign Application Priority Data

Jan. 6, 2021 (JP) ..... JP2021-000823

(51) Int. Cl.

| | |
|---|---|
| ***H01K 1/00*** | (2006.01) |
| ***H01R 43/02*** | (2006.01) |
| ***H01R 4/02*** | (2006.01) |
| ***H01R 11/12*** | (2006.01) |

(52) U.S. Cl.

CPC ..... *H01R 43/0207* (2013.01); *H01R 4/023* (2013.01); *H01R 11/12* (2013.01); *H01R 43/0263* (2013.01)

(58) Field of Classification Search

CPC ..... H05K 1/0206; H01R 4/18; H01R 4/187
USPC ..... 174/252
See application file for complete search history.

(56) References Cited

U.S. PATENT DOCUMENTS

| | | | | |
|---|---|---|---|---|
| 6,065,667 | A | 5/2000 | Singh | |
| 9,837,727 | B2 * | 12/2017 | Schmalbuch | H01R 12/57 |
| 10,297,956 | B2 * | 5/2019 | Abouklassem | H01R 13/6583 |
| 11,007,602 | B2 | 5/2021 | Idota et al. | |
| 2010/0170935 | A1 | 7/2010 | Stroh et al. | |

(Continued)

FOREIGN PATENT DOCUMENTS

| | | | |
|---|---|---|---|
| JP | 2005319497 | A | 11/2005 |
| JP | 2006260921 | A | 9/2006 |

(Continued)

OTHER PUBLICATIONS

Extended European Search Report (EESR) dated May 2, 2022, issued in counterpart European Application No. 21207657.4.

*Primary Examiner* — Phuong Chi Thi Nguyen
(74) *Attorney, Agent, or Firm* — Holtz, Holtz & Volek PC

(57) ABSTRACT

A busbar is placed on an anvil, and a core wire of a cable is placed on the busbar. While the core wire is pressed onto the busbar using a horn chip, ultrasonic vibration is given to the core wire to join the core wire to the busbar. The horn chip has two flat portions and a recessed portion located between the flat portions. When the core wire is pressed onto the busbar using the horn chip, each of the flat portions and the busbar sandwich a part of the core wire therebetween while the recessed portion and the busbar put a remaining part of the core wire therebetween. Each of the sandwiched parts of the core wire does not reach an outer end of the corresponding flat portion to leave a space between the corresponding flat portion and the busbar.

8 Claims, 12 Drawing Sheets

(56) References Cited

U.S. PATENT DOCUMENTS

| | | | | |
|---|---|---|---|---|
| 2011/0165800 | A1* | 7/2011 | Kakuta | H01R 4/62 439/880 |
| 2015/0236431 | A1* | 8/2015 | Schmalbuch | H01R 12/57 174/250 |
| 2015/0264800 | A1* | 9/2015 | Schmalbuch | H05K 1/0306 174/257 |
| 2016/0064717 | A1* | 3/2016 | Nishimura | H01M 50/502 429/158 |
| 2019/0148843 | A1* | 5/2019 | Idota | H01R 4/18 439/874 |

FOREIGN PATENT DOCUMENTS

| | | | |
|---|---|---|---|
| JP | 2012221915 | A | 11/2012 |
| JP | 6062593 | B1 | 12/2016 |
| JP | 6116740 | B1 | 3/2017 |
| JP | 6177394 | B1 | 7/2017 |
| JP | 2017162635 | A | 9/2017 |

* cited by examiner

METHOD OF MANUFACTURING CABLE ASSEMBLY, HORN CHIP USED IN THE METHOD AND CABLE ASSEMBLY MANUFACTURED BY THE METHOD

CROSS REFERENCE TO RELATED APPLICATIONS:

This application is based on and claims priority under 35 U.S.C. § 119 to Japanese Patent Application No. JP2021-000823 filed Jan. 6, 2021, the contents of which are incorporated herein in their entirety by reference.

BACKGROUND OF THE INVENTION:

This invention relates to a method of manufacturing a cable assembly, a horn chip used in the method and a cable assembly manufactured by the method.

A cable assembly is known in which a core wire of a cable is connected to a busbar. As one method of manufacturing such a cable assembly, there is an ultrasonic joining method. JP2017-162635A (Patent Document 1) discloses an example of a method of manufacturing a cable assembly using an ultrasonic joining method.

Referring to FIG. 17, the description will be made about a method of manufacturing an electric wire with a terminal (a cable assembly) described in Patent Document 1. First, a busbar 92 is placed on an anvil 90. Next, a core wire 940 of a covered electric wire (a cable) 94 is placed on the busbar 92. Next, using a welding horn (a horn chip) 96, the core wire 940 is pressed onto the busbar 92, and a high frequency vibration (an ultrasonic vibration) is given to the core wire 940. As a result, the core wire 940 is joined to the busbar 92.

As shown in FIG. 18, Patent Document 1 discloses a state that the core wire 940 is just filled up a groove 960 of the welding horn 96 and that a tip of the welding horn 96 is brought into contact with the busbar 92. However, in the state that the welding horn 96 is brought into contact with the busbar 92, the welding horn 96 receives a reaction force from the busbar 92, and thereby a force pressing the core wire 940 onto the busbar 92 is reduced. In addition, the ultrasonic vibration from the welding horn 96 leaks through a contact surface of the welding horn 96, which is brought into contact with the busbar 92, to the busbar 92, and thereby the ultrasonic vibration to be given to the core wire 940 is reduced. Accordingly, the method of manufacturing the electric wire with the terminal of Patent Document 1 has a problem that the force by which the welding horn 96 presses the core wire 940 onto the busbar 92 might be insufficient and a problem that the ultrasonic vibration given from the welding horn 96 to the core wire 940 might be insufficient. In addition, a contact state between the core wire 940 and the busbar 92 depends on manufacturing variation of the core wire 940 and others, and repeatability thereof cannot be expected. Accordingly, the method of manufacturing the electric wire with the terminal of Patent Document 1 has a problem that the force by which the welding horn 96 presses the core wire 940 onto the busbar 92 has variation and that the ultrasonic vibration given from the welding horn 96 to the core wire 940 has variation.

SUMMARY OF THE INVENTION

It is an object of the present invention to provide a method of manufacturing a cable assembly which can stably manufacture the cable assembly having suitable tensile strength in a joint surface of the cable assembly. Moreover, it is another object of the present invention to provide a horn chip used in the method of manufacturing the cable assembly. Furthermore, it is yet another object of the present invention to provide the cable assembly having suitable tensile strength in a joint surface thereof.

One aspect of the present invention provides a method of manufacturing a cable assembly. The method comprises: placing a busbar on an anvil; placing a core wire of a cable on the busbar; and giving an ultrasonic vibration on the core wire while pressing the core wire onto the busbar using a horn chip to join the core wire to the busbar. The horn chip has two flat portions, which are apart from each other in a first horizontal direction, and a recessed portion located between the flat portions in the first horizontal direction. Each of the flat portions and the recessed portion extends in a second horizontal direction perpendicular to the first horizontal direction. When the core wire is pressed onto the busbar using the horn chip, each of the flat portions and the busbar sandwich a part of the core wire therebetween while the recessed portion and the busbar put a remaining part of the core wire therebetween. Each of the sandwiched parts of the core wire, which is sandwiched between the flat portion corresponding thereto and the busbar, does not reach an outer end of the corresponding flat portion in the first horizontal direction to leave a space between the corresponding flat portion and the busbar, the space being positioned outward of the sandwiched part of the core wire in the first horizontal direction.

Another aspect of the present invention provides a horn chip which is used in the method mentioned above, wherein in a plane perpendicular to the second horizontal direction, a cross-sectional area of the recessed portion is at least 70% of a cross-sectional area of the core wire and at most 90% of the cross-sectional area of the core wire.

Yet another aspect of the present invention provides a cable assembly comprising a busbar and a cable provided with a core wire. The core wire has a joint portion joined to the busbar. The joint portion extends in a second horizontal direction. The joint portion has a plate portion brought into contact with the busbar and a raised portion raised upward from the plate portion. In a first horizontal direction perpendicular to the second horizontal direction, the plate portion has a size larger than that of the raised portion. The plate portion protrudes outward from each side of the raised portion in the first horizontal direction.

According to the method of manufacturing the cable assembly according to an aspect of the present invention, when the core wire is pressed onto the busbar using the horn chip, each of the flat portions of the horn chip and the busbar sandwich a part of the core wire therebetween while the recessed portion of the horn chip and the busbar puts a remaining part of the core wire therebetween. At this time, each of the sandwiched parts of the core wire, which is sandwiched between the corresponding flat portion and the busbar, does not reach an outer end of the corresponding flat portion in the first horizontal direction. Moreover, the space is left between each of the flat portions and the busbar. The space is positioned outward of each of the sandwiched parts of the core wire in the first horizontal direction. By giving the ultrasonic vibration to the core wire in the state mentioned above, tensile strength in a joint surface of the cable assembly can be increased.

The present invention also can provide a method of a manufacturing a cable with a terminal portion. The method comprises directly placing a core wire of a cable on an anvil, and giving an ultrasonic vibration on the core wire while pressing the core wire onto the anvil using a horn chip to deform the core wire and to form the terminal portion. The horn chip has two flat portions, which are apart from each other in a first horizontal direction, and a recessed portion located between the flat portions in the first horizontal direction. Each of the flat portions and the recessed portion extends in a second horizontal direction perpendicular to the first horizontal direction. When the core wire is pressed onto the anvil using the horn chip, each of the flat portions and the anvil sandwich a part of the core wire therebetween while the recessed portion and the anvil put a remaining part of the core wire therebetween. Each of the sandwiched parts of the core wire, which is sandwiched between the flat portion corresponding thereto and the anvil, does not reach an outer end of the corresponding flat portion in the first horizontal direction to leave a space between the corresponding flat portion and the anvil, the space being positioned outward of the sandwiched part of the core wire in the first horizontal direction.

The present invention further provides a cable with a terminal portion which has the terminal portion formed at an end portion of a core wire of a cable. The terminal portion extends in a second horizontal direction. The terminal portion has a plate portion and a raised portion raised upward from the plate portion. In a first horizontal direction perpendicular to the second horizontal direction, the plate portion has a size larger than that of the raised portion. The plate portion protrudes outward from each side of the raised portion in the first horizontal direction.

An appreciation of the objectives of the present invention and a more complete understanding of its structure may be had by studying the following description of the preferred embodiment and by referring to the accompanying drawings.

Figure 1:
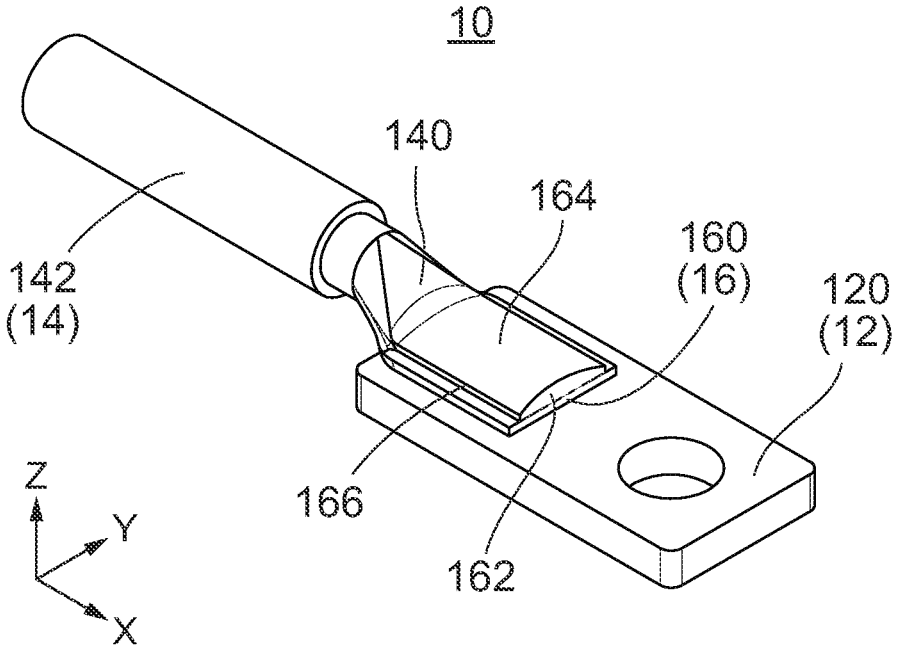
FIG. 1 is a perspective view showing a cable assembly according to an embodiment of the present invention. A chain double-dashed line between a plate portion of a joint portion and a raised portion of the joint portion is merely for describing the plate portion and the raised portion.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a cable assembly 10 according to an embodiment of the present invention is provided with a busbar 12 and a cable 14 connected to the busbar 12.

As shown in FIG. 1, in the present embodiment, the busbar 12 is a rectangular metal plate which is short in a first horizontal direction and long in a second horizontal direction perpendicular to the first horizontal direction. The busbar 12 is provided with a hole for a fixing bolt. The busbar 12 is made of copper, for example. In the present embodiment, the first horizontal direction is a Y-direction while the second horizontal direction is an X-direction. However, the present invention is not limited thereto. The busbar 12 may have a rectangular shape long in the first direction. Moreover, the shape of the busbar 12 is not limited to the rectangular shape but may be one of various polygons which includes an L-shape, a T-shape or the like. Furthermore, the busbar 12 may not have the hole or may have a plurality of holes.

As shown in FIG. 1, the cable 14 has a core wire 140 and a cover 142 covering a periphery of the core wire 140. The core wire 140 is exposed outside at an end portion of the cable 14 and connected to the busbar 12. In the present embodiment, the core wire 140 is a stranded wire in which a plurality of elemental wires is twined together.

Figure 2:
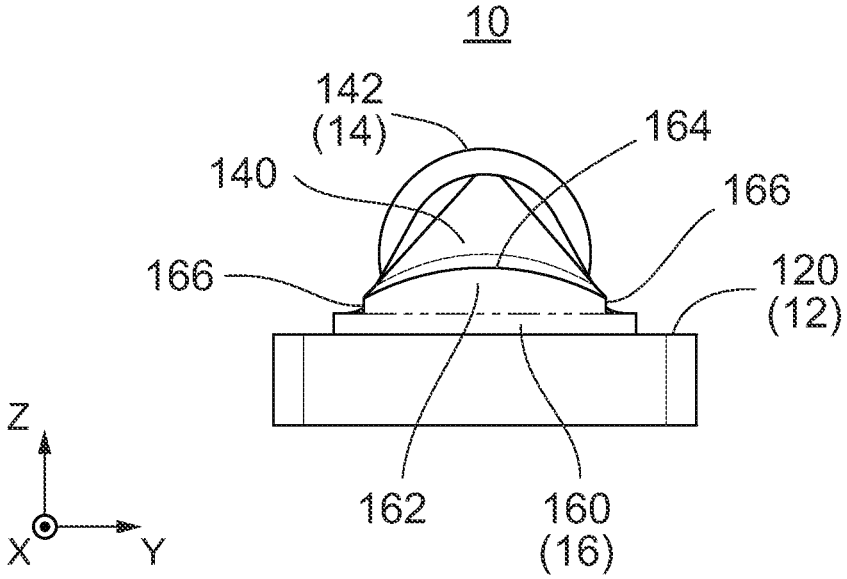
FIG. 2 is a front view showing the cable assembly of FIG. 1. A chain double-dashed line between the plate portion of the joint portion and the raised portion of the joint portion is merely for describing the plate portion and the raised portion.

As shown in FIGS. 1 and 2, the core wire 140 of the cable 14 has a joint portion 16 joined to an upper surface 120 of the busbar 12. The joint portion 16 has an approximately rectangular shape long in the second horizontal direction when viewed along an up-down direction. In other words, the joint portion 16 extends in the second horizontal direction. In the present embodiment, the up-down direction is a direction perpendicular to both of the first horizontal direction and the second horizontal direction, or a Z-direction. A positive Z-direction is directed upward while a negative Z-direction is directed downward.

As understood from FIGS. 1 and 2, the joint portion 16 of the core wire 140 has a plate portion 160 brought into contact with the busbar 12 and a raised portion 162 raised upward from the plate portion 160. The joint portion 16 has a common cross-sectional shape perpendicular to the second horizontal direction regardless of the position of the cross section in the second horizontal direction. The raised portion 162 is formed so that a cross-sectional area thereof is at least 70% and at most 90% of a cross-sectional area of the core wire 140 in a plane perpendicular to the second horizontal direction.

As understood from FIG. 2, in the first horizontal direction, the plate portion 160 has a size larger than that of the raised portion 162. In detail, the plate portion 160 protrudes outward from each side of the raised portion 162 in the first direction.

As shown in FIGS. 1 and 2, the raised portion 162 of the joint portion 16 has an upper surface 164, which is located apart from the plate portion 160 in the up-down direction, and a pair of side portions 166, which extend from the plate portion 160 to the upper surface 164. In the present embodiment, the upper surface 164 is a curved surface formed by raising a middle portion thereof in the first horizontal direction. In the present embodiment, the side portions 166 are flat surfaces extending in the up-down direction. However, the present invention is not limited thereto. The upper surface 164 may consist of a single flat surface or a plurality of flat surfaces. The side portions 166 may be inclined against the up-down direction.

Referring to FIGS. 3 to 11, the description will be made about a method of manufacturing the cable assembly 10 of FIGS. 1 and 2.

Figure 3:
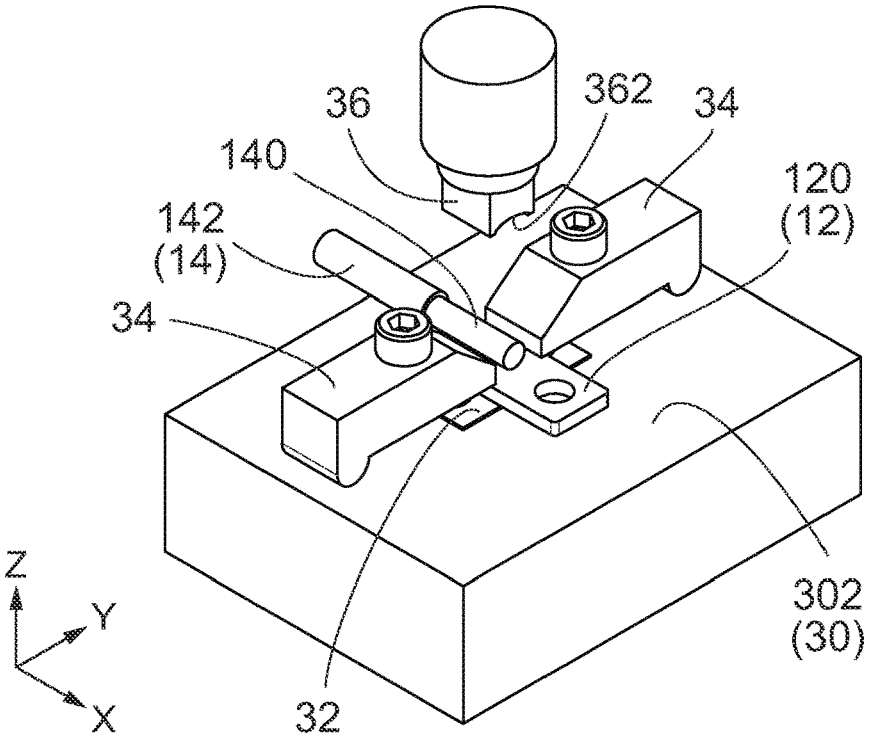
FIG. 3 is a perspective view showing one process of a method of manufacturing the cable assembly of FIG. 1. A busbar is placed on an anvil. The busbar is pressed onto the anvil by clamp arms. A core wire of a cable is placed on the busbar. A horn chip is positioned above the core wire.

As shown in FIG. 3, an ultrasonic joining device used in the method of manufacturing the cable assembly 10 according to the present embodiment is provided with a base 30, an anvil 32, two clamp arms 34 and a horn chip 36. Moreover, the ultrasonic joining device is provided with an ultrasonic vibration mechanism (not shown), which gives an ultrasonic vibration to the horn chip 36, and a pressurization mechanism (not shown), which moves the ultrasonic vibration mechanism and the horn chip 36 in the up-down direction.

Figure 7:
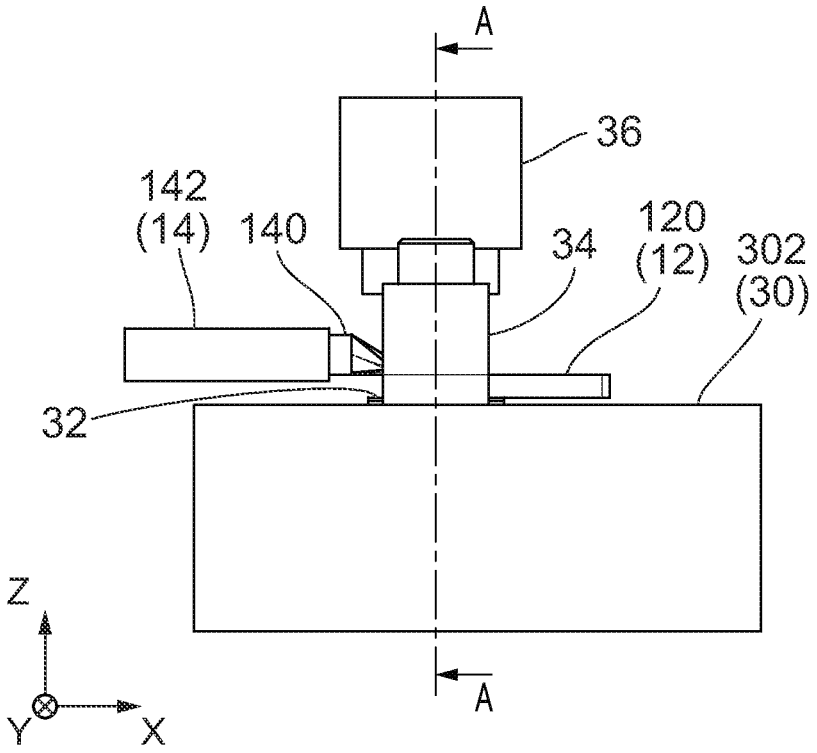
FIG. 7 is a side view showing the process of FIG. 5.
Figure 8:
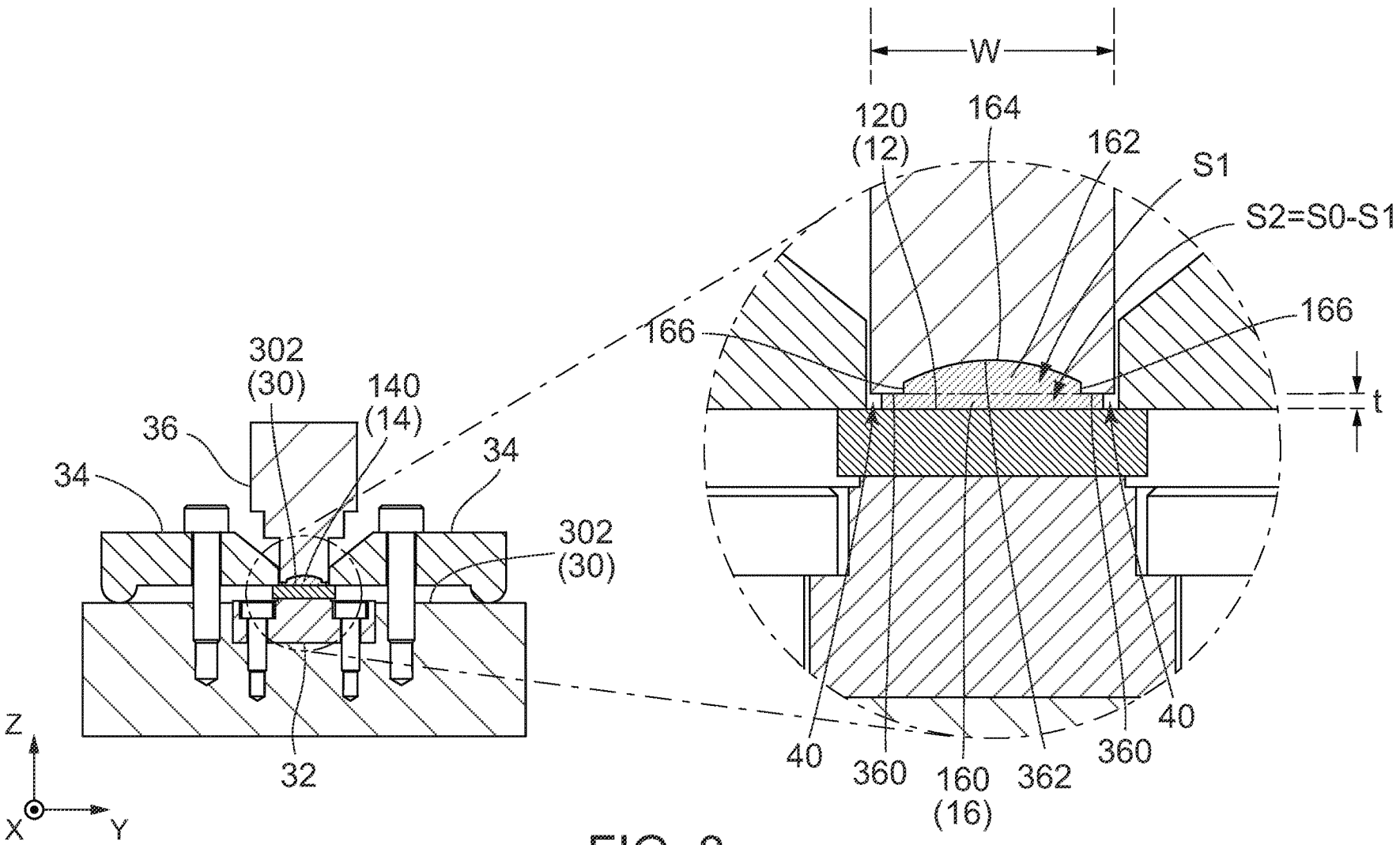
FIG. 8 is a cross-sectional view showing the process of FIG. 7, taken along line A-A. The joint portion and the vicinity thereof are shown on enlarged scale. A chain double-dashed line between the plate portion of the joint portion and the raised portion of the joint portion is merely for describing the plate portion and the raised portion.

As understood from FIGS. 3, 7 and 8, the anvil 32 is partly accommodated in an accommodation portion, which is formed in the base 30, and fixed to the base 30 using bolts. The anvil 32 protrudes upward from an upper surface 302 of the base 30 in part.

Figure 4:
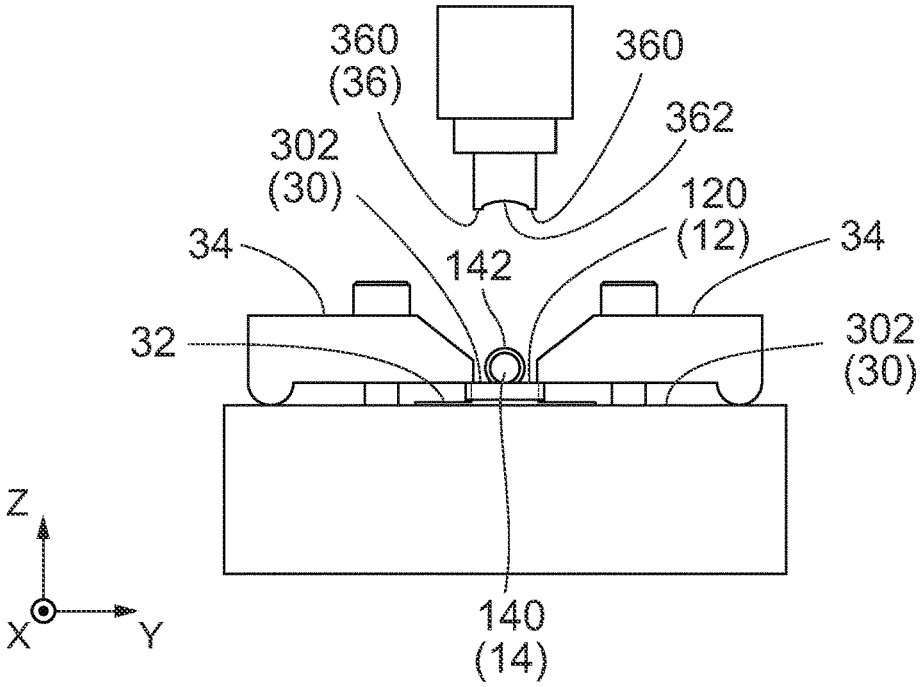
FIG. 4 is a front view showing the process of FIG. 3.
Figure 5:
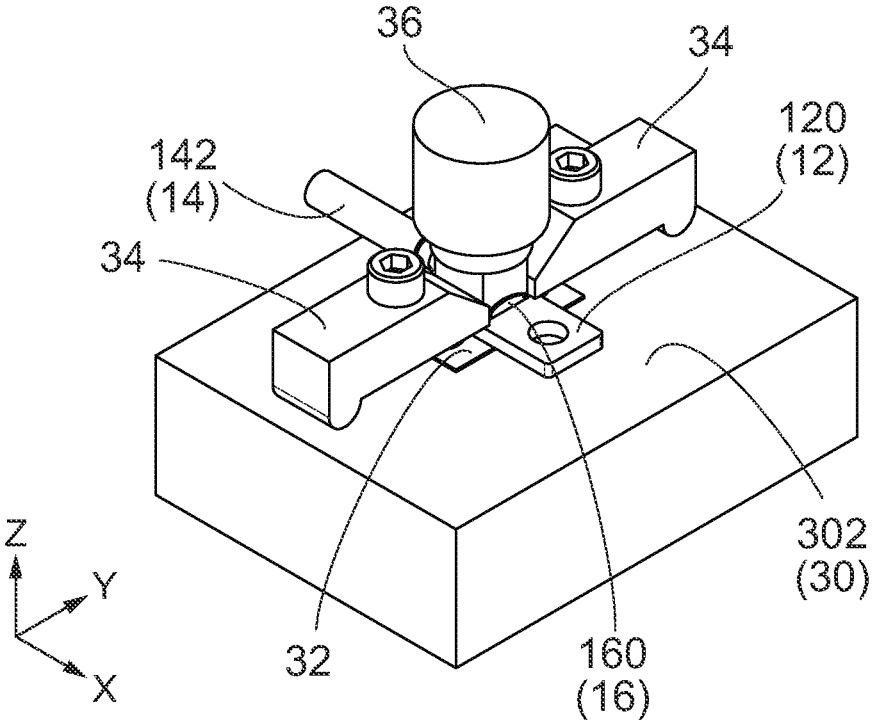
FIG. 5 is a perspective view showing another process following the process of FIG. 3. The horn chip presses the core wire onto the busbar.

As shown in FIGS. 3 and 4, each of the clamp arms 34 is attached to the base 30 using a bolt. The clamp arms 34 are located on both sides of the anvil 32 in the first horizontal direction to be apart from each other. When viewed along the up-down direction, the clamp arms 34 overlap with the anvil 32.

Referring to FIGS. 3 and 4, first, the busbar 12 is placed on the anvil 32. The busbar 12 is pressed onto the anvil 32 using the clamp arms 34 which are located on both sides of the busbar 12 in the first horizontal direction. Next, the core wire 140 of the cable 14 is placed on the busbar 12.

Subsequently, as shown in FIGS. 5 to 8, the horn chip 36 is pressed onto the core wire 140 placed on the busbar 12 using the pressurization mechanism (not shown). The core wire 140 is sandwiched between the horn chip 36 and the busbar 12 and deformed in accordance with a tip shape of the horn chip 36.

Figure 11:
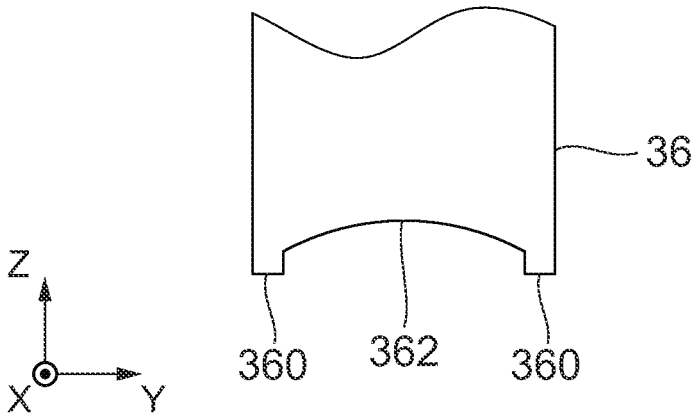
FIG. 11 is a front view showing a tip portion of the horn chip used in the method of manufacturing the cable assembly of FIG. 1.

As shown in FIG. 11, the horn chip 36 has two flat portions 360, which are apart from each other in the first horizontal direction, and a recessed portion 362, which is located between the flat portions 360 in the first horizontal direction. Each of the flat portions 360 and the recessed portion 362 extends in the second horizontal direction.

Figure 6:
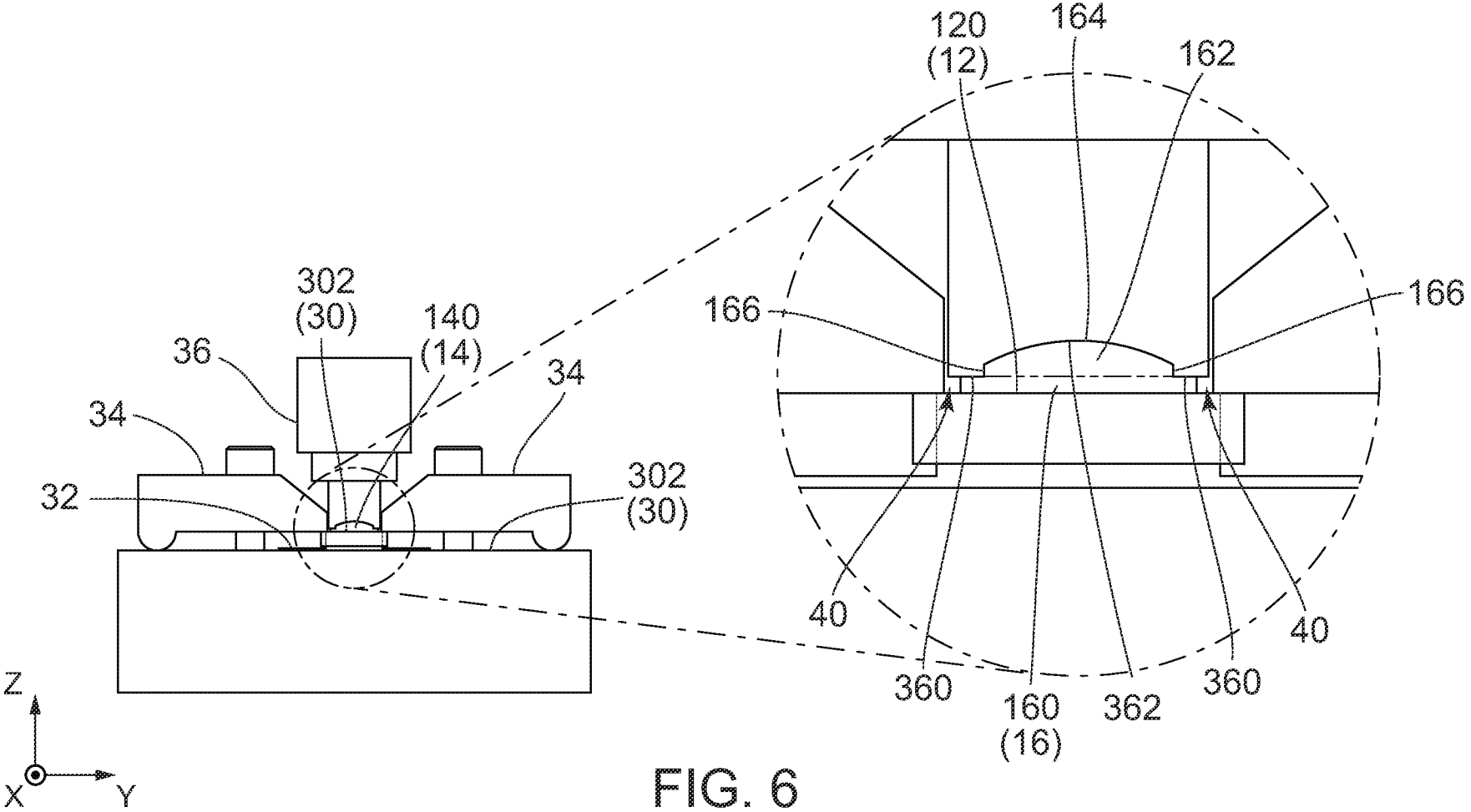
FIG. 6 is a front view showing the process of FIG. 5. The joint portion and the vicinity thereof are shown on enlarged scale. A chain double-dashed line between the plate portion of the joint portion and the raised portion of the joint portion is merely for describing the plate portion and the raised portion.

As shown in FIGS. 6 and 8, when the core wire 140 is pressed onto the busbar 12 using the horn chip 36, each of the flat portions 360 and the busbar 12 sandwich a part of the core wire 140 therebetween. Thus, a sandwiched part of the core wire 140 is formed between the flat portion 360 corresponding thereto and the busbar 12. At the same time, the recessed portion 362 of the horn chip 36 and the busbar 12 put a remaining part of the core wire 140 therebetween. The sandwiched part of the core wire 140 sandwiched between the corresponding flat portion 360 of the horn chip 36 and the busbar 12 does not reach an outer end of the corresponding flat portion 360 in the first horizontal direction. In other words, each of the sandwiched parts of the core wire 140 is formed to leave a space 40 outward thereof in the first horizontal direction. Thus, the space 40 is left between each of the flat portions 360 and the busbar 12 and positioned outward of an outer end of each of the sandwiched parts of the core wire 140 in the first horizontal direction. In order to realize such a state, in a plane perpendicular to the second horizontal direction, the horn chip 36 is designed so that a cross-sectional area of the recessed portion 362 is at least 70% and at most 90% of that of the core wire 140. Moreover, each of the flat portions 360 have a predetermined size in the first horizontal direction. The predetermined size satisfies a condition that the end of the core wire 140 do not reach the outer end of the flat portion 360 in the first horizontal direction when the core wire 140 is pressed onto the busbar 12 and deformed. In detail, the predetermined size is set to meet a formula: $W \times t > S2 = S0 - S1$, where W is a size of the horn chip 36 in the first horizontal direction, t is a thickness of the core wire 140 located outside the recessed portion 362, S0 is a cross-sectional area of the core wire 140, S1 is a cross-sectional area of the core wire 140 located in the recessed portion 362, and S2 is a cross-sectional area of the core wire 140 located outside the recessed portion 362.

As shown in FIGS. 5 to 8, under the state that the core wire 140 is pressed onto the busbar 12 using the horn chip 36, the horn chip 36 is given with ultrasonic vibration using the ultrasonic vibration mechanism. As shown in FIG. 8, at this time, the horn chip 36 is apart from the clamp arms 34. In other words, the horn chip 36 presses the core wire 140 onto the busbar 12 without contact with the clamp arms 34. In this state, the horn chip 36 resonates with the ultrasonic vibration given from the ultrasonic vibration mechanism and gives the ultrasonic vibration to the core wire 140. At this time, the horn chip 36 is apart from the clamp arms 34 and the busbar 12 and brought into contact with only the core wire 140. Accordingly, the ultrasonic vibration of the horn chip 36 is not transmitted to the clamp arms 34 but transmitted to only the core wire 140. In this manner, while the core wire 140 is pressed onto the busbar 12 using the horn chip 36, the ultrasonic vibration can be given to the core wire 140 without waste. As a result, the core wire 140 is ultrasonically joined to the busbar 12 appropriately. The core wire 140 does not protrude outward of the horn chip 36 in the horizontal direction, and the core wire 140 is appropriately joined to the busbar 12 to be able to obtain a desired tensile strength.

Figure 9:
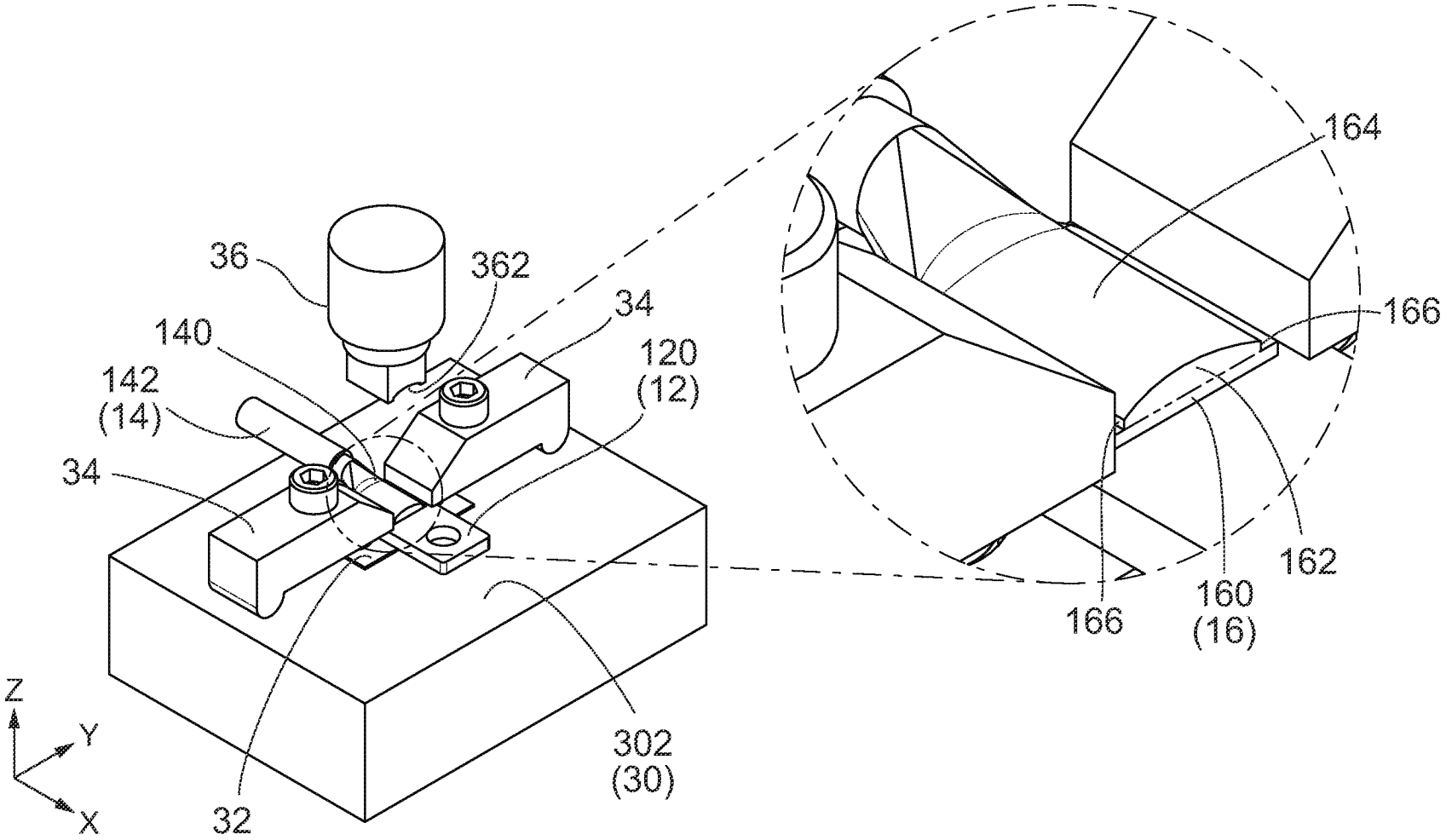
FIG. 9 is a perspective view showing yet another process following the process of FIG. 5. The horn chip is located above the core wire. The joint portion and the vicinity thereof are shown on enlarged scale. A chain double-dashed line between the plate portion of the joint portion and the raised portion of the joint portion is merely for describing the plate portion and the raised portion.
Figure 10:
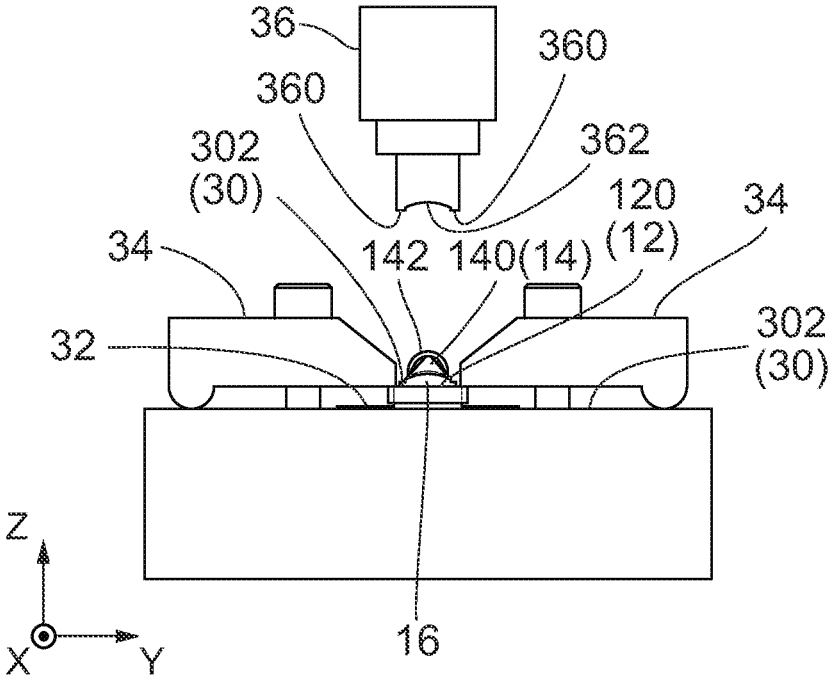
FIG. 10 is a front view showing the process of FIG. 9.

Subsequently, as shown in FIGS. 9 and 10, the horn chip 36 is moved upward. The end portion of the core wire 140 is deformed and forms the joint portion 16 joined to the busbar 12. In this way, the cable assembly 10 of FIGS. 1 and 2 is completed.

Figure 12:
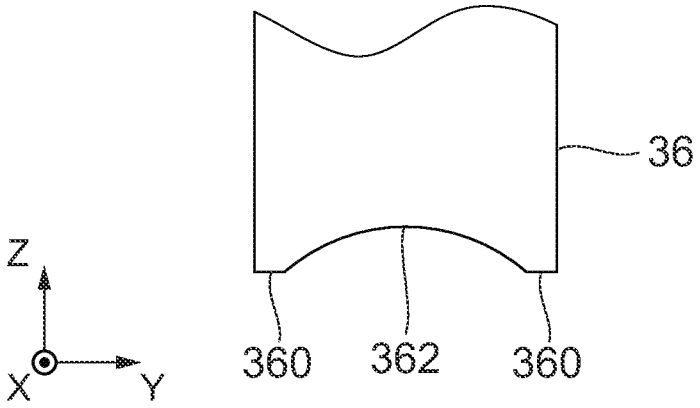
FIG. 12 is a front view showing a first modification of the tip portion of the horn chip used in the method of manufacturing the cable assembly of the present invention.

While the specific explanation about the present invention is made above with reference to the embodiments, the present invention is not limited thereto but susceptible of various modifications and alternative forms without departing from the spirit of the invention. For example, although the recessed portion 362 of the horn chip 36 is formed of one curved surface and two flat surfaces in the aforementioned embodiment, it may be formed of one curved surface as shown in FIG. 12.

Figure 13:
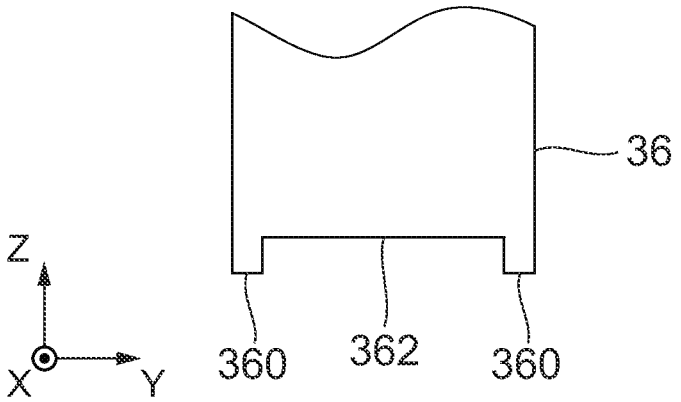
FIG. 13 is a front view showing a second modification of the tip portion of the horn chip used in the method of manufacturing the cable assembly of the present invention.
Figure 14:
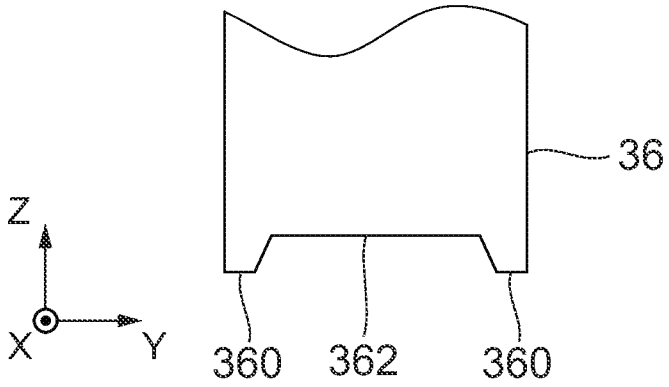
FIG. 14 is a front view showing a third modification of the tip portion of the horn chip used in the method of manufacturing the cable assembly of the present invention.
Figure 15:
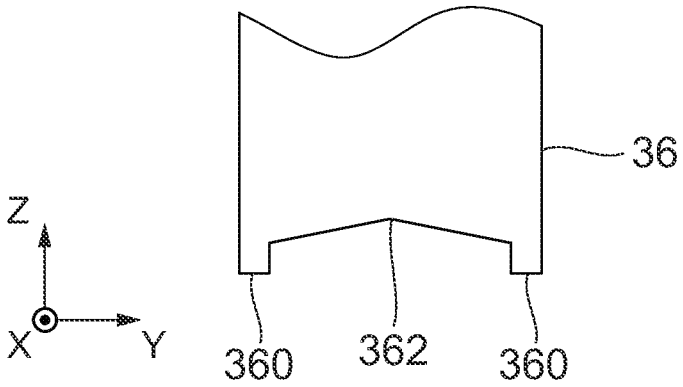
FIG. 15 is a front view showing a fourth modification of the tip portion of the horn chip used in the method of manufacturing the cable assembly of the present invention.

Alternatively, as shown in FIG. 13 or FIG. 14, the recessed portion 362 may be formed of three flat surfaces. Or, as shown in FIG. 15, the recessed portion 362 may be formed of four flat surfaces. Furthermore, each of the curved surface and the flat surfaces which form the recessed portion 362 may be formed with grooves to efficiently transmit the ultrasonic vibration to the core wire 140. The grooves may be a plurality of parallel or cross hatching grooves.

Moreover, the present invention is applicable to manufacturing of a cable assembly in which a terminal of a connector (not shown) which substitutes for the busbar 12 is connected to the cable 14. In that case, a shape of the terminal is not particularly limited. The terminal may be a male terminal or a female terminal. The terminal, however, should have a flat surface having some area to be connected to the cable 14.

Figure 16:
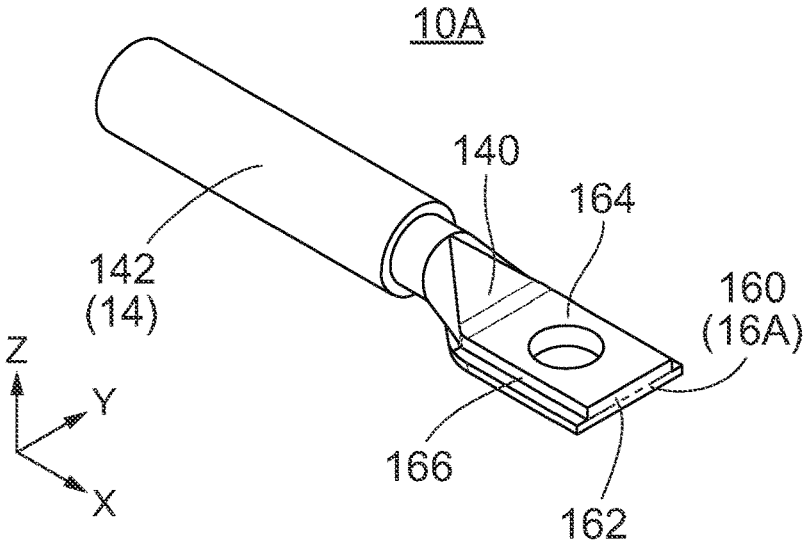
FIG. 16 is a perspective view showing a cable with a terminal portion which is manufactured by applying the method of manufacturing the cable assembly of the present invention. A chain double-dashed line between a plate portion of a joint portion and a raised portion of the joint portion is merely for describing the plate portion and the raised portion.
Figure 17:
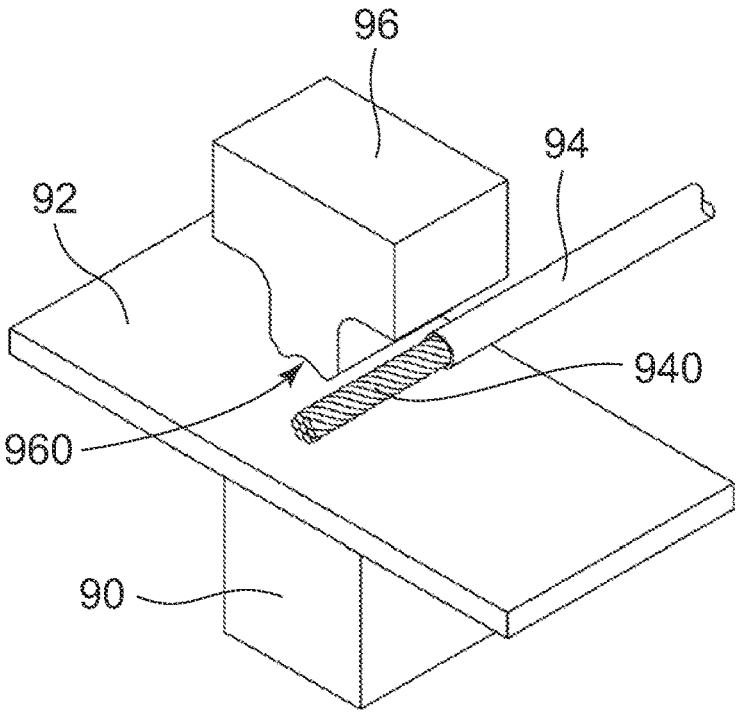
FIG. 17 PRIOR ART
FIG. 17 is a perspective view showing one process of a method of manufacturing an electric wire with a terminal which is disclosed in Patent Document 1.
Figure 18:
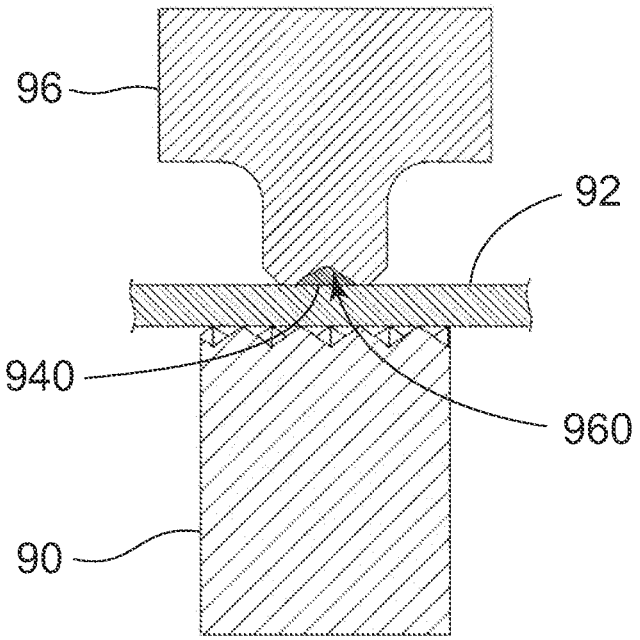
FIG. 18 PRIOR ART
FIG. 18 is a perspective view showing another process of the method of manufacturing the electric wire with the terminal which is disclosed in Patent Document 1.

Furthermore, the present invention is also applicable to manufacturing of a cable with a terminal portion which does not have the busbar 12. For example, as shown in FIG. 16, a cable with a terminal portion 10A has a terminal portion 16A formed at an end portion of a core wire 140 of a cable 14. The cable with the terminal portion 10A can be manufactured by directly placing the core wire 140 of the cable 14 on an anvil 32 (see FIG. 3) and by using a method similar to the method mentioned above. In detail, while the core wire 140 is pressed onto the anvil 32 using a horn chip 36 (see FIGS. 5 and 6), ultrasonic vibration is given to the core wire 140 to deform the core wire 140 and to form the terminal portion 16A. Elemental wires of the core wire 140 are ultrasonically joined together, and thereby the end portion of the core wire 140 is hardened in its deformed shape to form the terminal portion 16A. As shown in FIG. 16, after ultrasonic joining for deforming and hardening the terminal portion 16A, a hole for a fixed bolt may be formed in the terminal portion 16A. It should be noted that, if the method described in Patent Document 1 is used for manufacturing a cable with a terminal portion, a force and an ultrasonic vibration cannot be appropriately given to the core wire 140. Accordingly, it is difficult to form the terminal portion 16A. In addition, in that case, the horn chip 36 might be worn down or damaged by contact with the anvil 32.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A method of manufacturing a cable assembly, the method comprising:

placing a busbar on an anvil;

placing a core wire of a cable on the busbar; and giving an ultrasonic vibration on the core wire while pressing the core wire onto the busbar using a horn chip to join the core wire to the busbar, wherein:

the horn chip has two flat portions, which are apart from each other in a first horizontal direction, and a recessed portion located between the flat portions in the first horizontal direction;

each of the flat portions and the recessed portion extends in a second horizontal direction perpendicular to the first horizontal direction;

when the core wire is pressed onto the busbar using the horn chip, each of the flat portions and the busbar sandwich a part of the core wire therebetween while the recessed portion and the busbar put a remaining part of the core wire therebetween; and each of the sandwiched parts of the core wire, which is sandwiched between the flat portion corresponding thereto and the busbar, does not reach an outer end of the corresponding flat portion in the first horizontal direction to leave a space between the corresponding flat portion and the busbar, the space being positioned outward of the sandwiched part of the core wire in the first horizontal direction.

2. The method as recited in claim 1, wherein:

the busbar is pressed onto the anvil using two clamp arms which are located on both sides of the busbar in the first horizontal direction; and the horn chip presses the core wire onto the busbar without contact with the clamp arms and gives the ultrasonic vibration to the core wire.

3. A horn chip which is used in the method as recited in claim 1, wherein in a plane perpendicular to the second horizontal direction, a cross-sectional area of the recessed portion is at least 70% of a cross-sectional area of the core wire and at most 90% of the cross-sectional area of the core wire.

4. A cable assembly comprising a busbar and a cable provided with a core wire; wherein:

the core wire has a joint portion joined to the busbar;

the joint portion extends in a second horizontal direction;

the joint portion has a plate portion brought into contact with the busbar and a raised portion raised upward from the plate portion;

in a first horizontal direction perpendicular to the second horizontal direction, the plate portion has a size larger than that of the raised portion; and the plate portion protrudes outward from each side of the raised portion in the first horizontal direction.

5. The cable assembly as recited in claim 4, wherein the core wire is a twisted wire in which a plurality of elemental wires is twisted together.

6. The cable assembly as recited in claim 4, wherein in a plane perpendicular to the second horizontal direction, a cross-sectional area of the raised portion is at least 70% and at most 90% of a cross-sectional area of the core wire.

7. The cable assembly as recited in claim 4, wherein the raised portion has an upper surface located apart from the plate portion in an up-down direction perpendicular to both of the first horizontal direction and the second horizontal direction and side portions extending from the plate portion to the upper surface.

8. The cable assembly as recited in claim 7, wherein the side portions extend in the up-down direction.

* * * * *